US006684461B1

(12) United States Patent
Barnhardt

(10) Patent No.: US 6,684,461 B1
(45) Date of Patent: Feb. 3, 2004

(54) MATTRESS HANDLE FORMED OF A TEXTILE WEB WITH CUSHIONED EDGES

(75) Inventor: William B. Barnhardt, Greensboro, NC (US)

(73) Assignee: Southern Webbing Mills, Inc., Greensboro, NC (US)

( * ) Notice: Subject to any disclaimer, the term of this patent is extended or adjusted under 35 U.S.C. 154(b) by 0 days.

(21) Appl. No.: 10/051,722

(22) Filed: Jan. 17, 2002

(51) Int. Cl.[7] ..... A45F 5/10

(52) U.S. Cl. ..... 16/443; 16/110.1; 16/114.1; 16/DIG. 28

(58) Field of Search ..... 16/443, 444, 446, 16/110.1, 114.1, DIG. 28; 383/20, 21, 22, 24; 224/202, 257, 258, 264; 112/470.07, 470.08, 470.33; 5/703; 206/315.3; 150/107; 428/36.1, 36.2, 36.3, 36.91

(56) References Cited

U.S. PATENT DOCUMENTS

| | | | | | |
|---|---|---|---|---|---|
| 548,031 | A | | 10/1895 | Bringham | |
| 1,035,222 | A | | 8/1912 | Minchin | |
| 1,731,530 | A | | 10/1929 | Goldeen et al. | |
| 2,131,211 | A | * | 9/1938 | Bechik | 5/703 |
| 2,154,556 | A | * | 4/1939 | Bechik | 5/704 |
| 3,514,797 | A | | 6/1970 | Zysman | 5/345 |
| 3,626,525 | A | | 12/1971 | Fasanella | 5/345 |
| 4,262,385 | A | * | 4/1981 | Norman | 16/411 |
| 4,431,226 | A | | 2/1984 | Weilert | 294/150 |
| 4,592,091 | A | * | 5/1986 | Italici | 383/15 |
| 4,696,077 | A | * | 9/1987 | Kim | 16/114.1 |
| 4,782,556 | A | * | 11/1988 | Kim | 16/444 |
| 4,978,044 | A | * | 12/1990 | Silver | 224/601 |
| 5,056,533 | A | | 10/1991 | Solano | 128/845 |
| 5,062,717 | A | * | 11/1991 | Shockley | 383/20 |
| 5,343,776 | A | * | 9/1994 | Falco et al. | 74/558 |
| 5,430,901 | A | | 7/1995 | Farley | 5/464 |
| 5,534,336 | A | * | 7/1996 | Nomura et al. | 442/195 |
| 5,738,029 | A | | 4/1998 | Porter et al. | 112/470.07 |
| 5,765,735 | A | * | 6/1998 | Kimchi et al. | 224/264 |
| 5,864,907 | A | | 2/1999 | Hutton et al. | 5/703 |
| 5,881,656 | A | | 3/1999 | Grant | 112/2.1 |
| 6,006,403 | A | * | 12/1999 | Battiato | 16/421 |

FOREIGN PATENT DOCUMENTS

| | | | |
|---|---|---|---|
| CA | 0227165 | * | 5/1995 |

* cited by examiner

*Primary Examiner*—Chuck Y. Mah
(74) *Attorney, Agent, or Firm*—Kennedy Covington Lobdell & Hickman, LLP

(57) ABSTRACT

A handle for a mattress, box spring or other bedding structure is formed of an elongate textile web having a lengthwise-extending relatively stiffer main body and relatively softer lengthwise-extending cushioning edges along opposite sides of the main body. The main body preferably comprises two face-abutting layers of the textile web with the cushioning edges connecting the two layers at each opposite side of the main body. The textile web may be of a crochet-type warp-knitted fabric comprised of interknitted warp and filling yarns.

13 Claims, 2 Drawing Sheets

MATTRESS HANDLE FORMED OF A TEXTILE WEB WITH CUSHIONED EDGES

FIELD OF THE INVENTION

The present invention relates generally to handles for mattresses, box springs and like bedding structures and, more particularly, to such bedding handles formed of a textile fabric or other textile webbing.

BACKGROUND OF THE INVENTION

Mattresses, box springs and similar bedding structures are typically equipped with one or more handles along the sides thereof to facilitate lifting, carrying and maneuvering of these bedding structures. Conventionally, such handles may be of several differing constructions. Many mattresses and box springs are formed with grommets in the side walls of the bedding structure through which a loop of a cord of circular cross-section extends and is secured internally to the framework of the bedding to form an exteriorly exposed handle. In other mattresses, box springs and like bedding structures, a handle may be fashioned of the same ticking fabric as is used to cover the bedding structure itself. However, since such ticking fabrics typically are relatively pliable to promote the comfort of the bedding, it is commonplace to enhance the strength of the fabric handles by incorporating additional webbing, padding or filler material to enhance the substance and rigidity of the handle.

While handles of the above-described type have been in common widespread use for many years, these handles suffer several disadvantages. Most significantly, the known handles, whether of a cord-like construction or of a stiffened fabric construction, are uncomfortable and even painful to a user's hands due to the shape and stiffness of such handles, but especially in view of the ever increasing size and weight of mattresses, box springs and other bedding. Further, conventional handles can be costly and time-consuming to manufacture, particularly handles which must be assembled and sewn together utilizing a ticking fabric in conjunction with supplementary stiffening webbing, padding or filler material.

SUMMARY OF THE INVENTION

It is accordingly an object of the present invention to provide an improved handle construction for use in mattresses, box springs and like bedding, which overcomes the disadvantages of conventional handles described above. A more particular object of the present invention is to provide such an improved handle construction which will be more comfortable and functional than conventional handles when in use and is more economical to manufacture.

Briefly summarized, the present invention basically provides a bedding handle comprising an elongate textile web having a relatively stiffer main body extending lengthwise of the web and relatively softer cushioning edges extending lengthwise of the web along opposite sides of the main body. In a preferred embodiment, the main body comprises two face-abutting layers of the textile web and the cushioning edges connect the two layers at each opposite side of the main body.

The textile web may be of essentially any textile fabric construction, but most preferably is of a crochet-type warp-knitted fabric comprising a set of warp yarns extending lengthwise through each layer of the main body and multiple fillings extending traversely of the warp yarns and interknitted therewith, whereby the main body comprises the interknitted warp yarns and the fillings, while the cushioning edges comprise only fillings, preferably in the form of floats extending across the cushioning edges. Preferably, the textile fabric comprises at least four fillings, including two base fillings which extend traversely through each layer of the main body and across the cushioning edges, and at least two pattern fillings traversing only one layer of the main body in a pre-determined pattern. The base fillings preferably traverse in opposing mirror-image relation to one another and the pattern fillings likewise traverse in opposing mirror image relation to one another, preferably forming a diamond-like pattern.

DESCRIPTION OF THE PREFERRED EMBODIMENT

Figure 1:
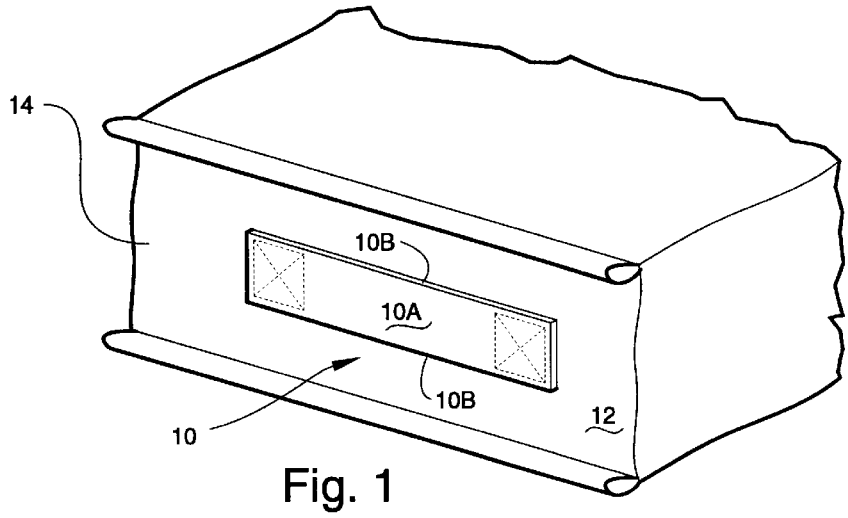
FIG. 1 is a fragmentary perspective view of a mattress whose side wall incorporates a handle in accordance with the present invention.
Figure 2:
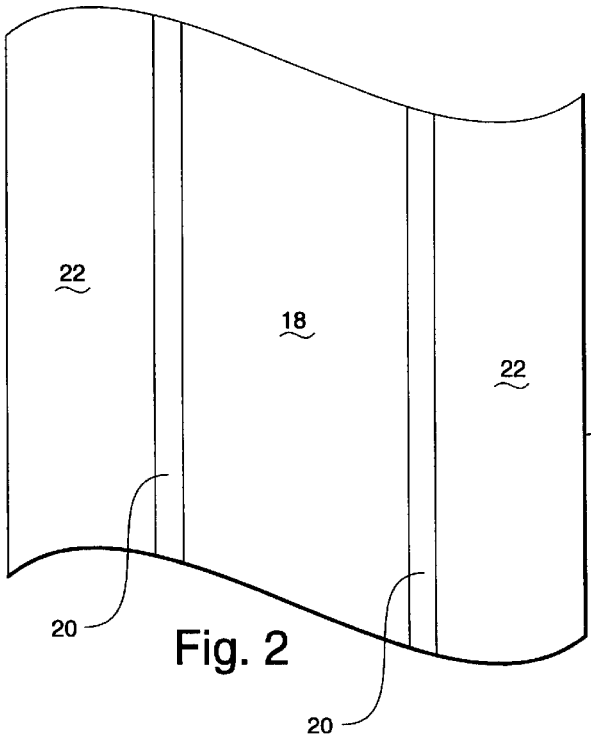
FIG. 2 is a schematic perspective view of a textile web from which the handle of the present invention in FIG. 1 is fabricated.
Figure 3:
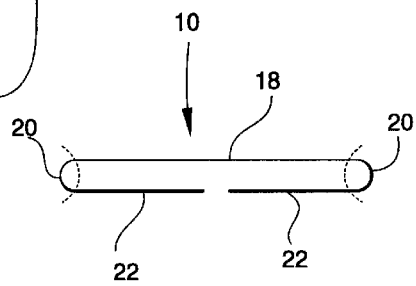
FIG. 3 is a cross-sectional view of the fabric of FIG. 2 after being formed into the handle of FIG. 1.

With reference now to the accompanying drawings and initially to FIGS. 1–3, a preferred embodiment of a bedding handle in accordance with the present invention is depicted in FIG. 1 at 10 as installed, e.g. by sewing, on the fabric side wall 12 of an otherwise conventional mattress 14.

As represented in FIG. 2, the handle 10 is made from a textile fabric 16 having the required length for the handle 10 and essentially twice the desired width of the finished handle 10. The fabric 16 is formed with a lengthwise-extending central main body portion 18, two lengthwise extending fold portions 20 extending along each laterally outward side of the central main body portion 18, and two supplementary main body portions 22 extending lengthwise along the opposite laterally outward sides of the fold portions 20.

As shown in FIG. 3, the completed handle 10 is formed by folding the fabric 16 lengthwise along the fold portions 20 to bring the outward edges of the supplementary body portions 22 into edge-abutment with one another and thereby disposing the supplementary body portions 22 in face abutting relation to the underside of the central main body portion 18, with the fold portions 20 thusly forming the lateral edges of the finished handle 10. The abutting edges of the supplementary body portions 22 are joined to one another by any suitable means, e.g., by sewing, gluing, ultrasonic welding, etc. In this manner, the finished handle 10 has a lengthwise-extending main body 10A formed by the face-abutting layers of the central main body portion 18 in combination with the supplementary body portions 22, and lengthwise-extending cushioning edges 10B.

In accordance with the present invention, the central and supplementary body portions 18, 22 of the fabric 16 are formed of a suitable textile construction to impart a relatively significant degree of stiffness and resistance to bending and bunching of the fabric within the main body 10A in the finished handle 10. In contrast, however, the fold portions 20 are made in a suitable construction to impart a substantially softer hand and feel to the cushioning edges 10B relative to the main body 10A, thereby to provide a cushioning character to the opposite lateral edges of the finished handle 10. In a preferred embodiment, the textile fabric 16 is of a crochet-type warp knitted construction, but it is contemplated to be within the scope of the present invention that equally suitable fabrics 16 may be formed by other textile fabrication methodologies, e.g., by weaving, braiding, etc.

Figure 4:
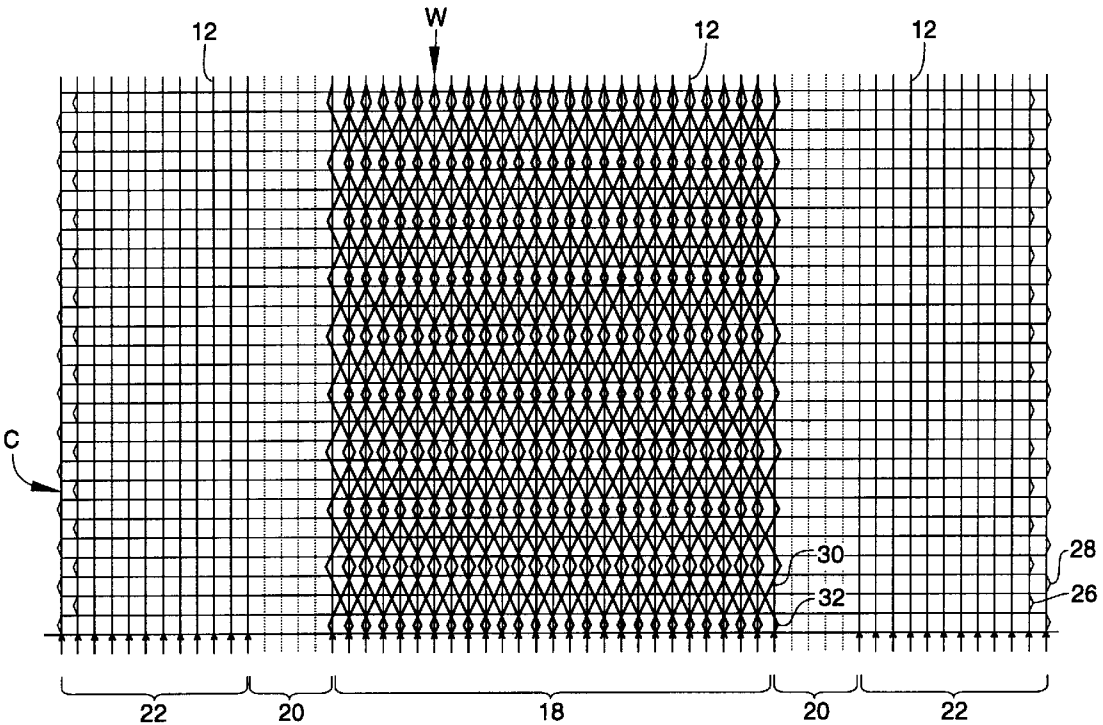
FIG. 4 is a schematic diagram depicting in a top plan view the stitch construction of the textile fabric of FIG. 2 in accordance with the preferred embodiment of the present invention.
Figure 6:
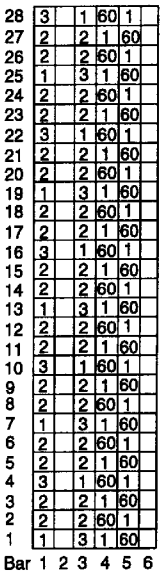
FIG. 6 is a chart setting forth the numerical stitch notation for the shogging patterns respectively followed by the filling yarns in the textile fabric of FIGS. 4 and 5, also similarly keyed in correspondence to the schematic diagram of FIG. 4.
Figure 5:
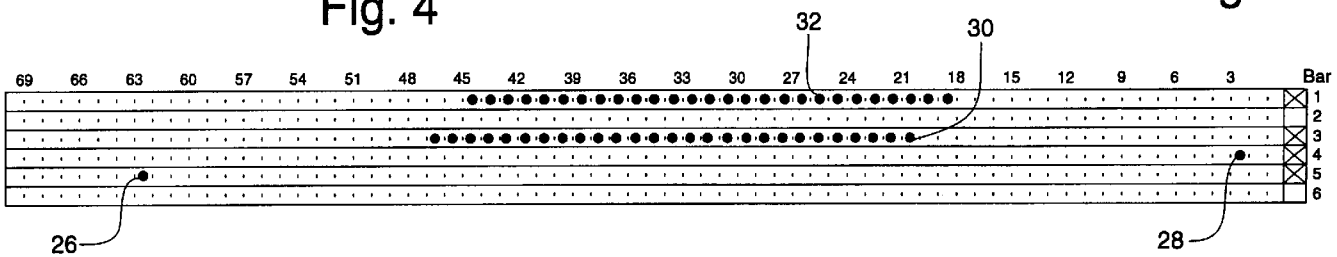
FIG. 5 is a schematic diagram depicting the layered configuration of the filling yarns in the textile fabric of FIG. 4, keyed to the schematic diagram of FIG. 4.

Referring now FIGS. 4–6, a preferred embodiment of the fabric 16 in a crochet-type warp-knitted textile fabric construction is depicted. This embodiment of the fabric 16 is fabricated on a crochet-type warp knitting machine such as manufactured by the Comez Company of Italy, but as those persons skilled in the relevant art and industry will recognize and understand, many other crochet and warp knitting machines may likewise be utilized to produce the same and similar bedding handle fabrics.

Basically, the fabric 16 comprises a single set of warp yarns 24 (FIG. 4) fed from a warp beam (not shown) or other suitable feeding mechanism. In the preferred form of the fabric 16 depicted in FIGS. 4–6, the warp comprises a total of fifty-two warp yarns 24 fed into the warp knitting machine in conventional fashion in the form of a sheet of the warp yarns traveling in parallel side-by-side form. Importantly, however, as represented in FIG. 4, the warp yarns 24 are fed in three spaced-apart groups to form the central and the supplementary body portions 18, 22 but with the warp yarns 24 absent from the fold portions 20.

The fabric 16 further includes four differing fillings 26, 28, 30, 32, respectively, fed weftwise, i.e., traversely, with respect to the warp yarns 24 by means of four differing feed bars designated in FIGS. 5 and 6 as Bars 1, 3, 4 and 5 (Filling Bar 2 being inactive in the fabrication of the current fabric 16). The first filling 26 comprises a base filling yam fed by Filling Bar 5 to traverse laterally back-and-forth across the full width of the warp sheet of yarns 24, i.e., across the entirety of each of the central main body portion 18, the fold portions 20, and the supplementary body portions 22. Similarly, the second filling 28 comprises a base filling yarn fed by Filling Bar 4 to traverse laterally back-and-forth across the full width of the warp sheet of yarns 24 but in mirror-image opposition to the filling yarn 26. The third filling 30 comprises asset of multiple pattern filling yarns (in the preferred embodiment a total of twenty-seven filling yarns 30) fed in uniformly spaced side-by-side relation by Filling Bar 3 to traverse weftwise back-and-forth laterally relative to only the group of warp yarns 24 forming the central main body portion 18 by reciprocal shoggin, movements of the Filling Bar 3 of an amount corresponding to the spacing of two warp yarns 24. The fourth filling 32 silmilarly comprises a set of plural uniformly spaced pattern filling yarns (also preferably a total of twenty-seven filling yarns 32 in the illustrated construction) fed by Filling Bar 1 which likewise shoggs back and forth laterally relative to the group of the warp yarns 24 forming the central main body portion 18 in reciprocating movements equivalent to the spacing of two warp yarns 24 but in mirror-image opposed relation to the filling yarns 30 of Filling Bar 3.

In conventional fashion, the warp knitting machine manipulates the warp yarns 24 by means of a needle bar (not shown) of the machine to form each warp yarn 24 into a series of sequential uniformly-spaced chain stitches extending lengthwise along the fabric 16 in parallel with each other warp yarn 24, the chain stitches thereby being aligned in parallel lengthwise extending wales W along the full length of the fabric and weftwise (i.e. widthwise) parallel courses C. As the chain stitches of the warp yarns 24 are being formed in each sequential course, the Filling Bars 4 and 5 inlay the respective base filling yarns 28, 26 within the loops of the chain stitches of each Course C, thereby forming a base fabric structure which appears at the technical face of the fabric. Simultaneously, the Filling Bars 1 and 3 inlay their respective sets of pattern filling yarns 32, 30, each across two warp yarns 24 whereby the pattern filling yarns 30, 32 form a pattern layer of the fabric 16 at the technical back of the fabric structure, with the opposing motions of the Filling Bars 1 and 3 forming the pattern filling yarns in a diamond-like pattern as depicted in FIG. 4. Preferably, the timing of the motions of the Filling Bars 1 and 3 is slightly retarded or delayed relative to manipulation of the warp yarns 24 by the needle bar and the manipulation of the base filling yarns 26, 28 by Filling Bars 4 and 5 so that the pattern filling yarns 30 and 32 are not inlaid through the loops of the chain stitches of the warp yarn 24 but instead inlaid underneath the underlaps of the warp yarns 24, i.e., the lengthwise segments of the warp yarns extending between the successive chain stitches.

As those persons skilled in the art will recognize and understand, the crochet-knitted fabric 16 provides unique advantages in the use of such fabric to form the handle 10. As a result of the above-described knitted stitch construction of the fabric 16, the central main body portion 18 has all of the constituent warp and filling yarns 24, 26,28, 30, 32 interknitted together within the central main body portion 18, thereby imparting a substantial degree of structural rigidity and stiffness to this portion of the fabric 16. Likewise, the supplementary body portions 22 incorporate the warp yarns 24 and the base filling yarns 26, 28, thereby also imparting a relative degree of stiffness and rigidity to the supplementary body portions 22, albeit somewhat less stiff and rigid than the central main body portion 18. In contrast, the fold portions 20 are comprised only of the transversely extending base filling yarns 26, 28 which, owing to the absence of any warp yarns within the fold portions 20 are formed as unstitched floats spanning between the central and supplementary body portions 18, 22, whereby the fold areas are of a substantially softer and more cushioning hand and feel in comparison to the body portions 18, 22 of the fabric 16.

Thus, when the fabric 16 is folded as above-described to form the handle 10, the face-abutting central main body portion 18 and the supplementary body portions 22 combine to form the main body 10A of the handle 10 with a substantial degree of structural rigidity, stiffiess and dimensional stability so as to resist bending and buckling when manually grasped in the lifting and maneuvering of a mattress to which the handle 10 is attached. At the same time, however, the softness and cushioning character imparted to the edges 10B of the handle 10 by the fold portions 20 of the fabric 16 protect the user's hands from discomfort, abrasion, and possible pain or even injury from the stiffness of the main body 10A of the handle 10.

The simplicity of fabricating the handle 10 from the crochet-knitted fabric 16 with minimal labor required enables the production of the handle 10 at an increased capacity in comparison to other conventional fabric handles and at reduced costs, while providing at least comparable and, in most cases, superior performance. The pattern executed by the pattern filling 30, 32 provides a decorative and esthetically pleasing appearance to the finished handle 10. Moreover, by the use of a crochet knitting machine to make the fabric 16, numerous other patterning possibilities become available.

Those persons skilled in the relevant art and industry will also recognize and understand that numerous variations and modifications may be made in the fabric and handle of the present invention without departing from the substance and scope of the invention. For example, the use of additional fillings, variations and the sizes and types of the filing and warp yarn and variation in the stitch patterns executed by the Filling Bars 1 and 3, will enable the selective engineering of the physical characteristics of the fabric and the resultant handle. These and other variations are intended to be within the scope and substance of the present invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof

What is claimed is:

1. A bedding handle comprising main body extending in a lengthwise direction and cushioning edges extending in the lengthwise direction along opposite sides of the main body, the main body and the cushioning edges comprising integral portions of an elongate textile web wherein the main body has a contrasting textile structure to the textile structure of the cushioning edges which renders the main body relatively stiffer than the cushioning edges and the cushioning edges relatively softer than the main body.

2. The bedding handle of claim 1, wherein the textile web comprises a warp knitted fabric having a crochet knitted stitch structure.

3. The bedding handle of claim 2, wherein the warp knitted fabric comprises a set of warp yarns and multiple filling yarns interknitted with one another.

4. The bedding handle of claim 3, wherein the warp yarns and the filling yarns are interknitted with one another only within the main body and only the filling yarns are present in the cushioning edges.

5. The bedding handle of claim 4, wherein the filling yarns of the cushioning edges are formed as floats across the cushioning edges unknitted with any warp yarns in the cushioning edges.

6. The bedding handle of claim 4, wherein the main body comprises at least four filling yarns.

7. The bedding handle of claim 6, wherein the filling yarns comprise two base filling yarns, fully traversing the main body and the cushioning edges, and two pattern filling yarns traversing relative to one another in a predetermined pattern.

8. The bedding handle of claim 7, wherein the pattern filling yarns form a diamond pattern.

9. The bedding handle of claim 1, wherein the main body comprises two face-abutting layers and the cushioning edges connect the two layers at each opposite side of the main body.

10. The bedding handle of claim 9, wherein the textile web is a warp knitted fabric having a crochet knitted stitch structure comprising a set of warp yarns and multiple filling yarns interknitted with one another, the warp yarns extending lengthwise through each layer of the main body only and the multiple filling yarns comprising at least two base filling yarns extending traversely through each layer of the main body and the cushioning edges.

11. The bedding handle of claim 10, wherein the multiple filling yarns further comprise at least two pattern filling yarns traversing one layer of the main body relative to one another in a predetermined pattern.

12. The bedding handle of claim 10, wherein the base filling yarns traverse in opposing mirror-image relation to one another and the pattern filling yarns traverse in opposing mirror-image relation to one another.

13. The bedding handle of claim 9, wherein the textile web comprises a lengthwise extending central body portion, two supplementary body portions lengthwise extending along opposite lateral edges of the central body portion in laterally spaced relation thereto, and two elongate fold portions lengthwise extending along each laterally outward side of the central body portion between the central body portion and the supplementary body portions, the textile web being folded lengthwise along the fold portions to dispose the central body portion and the supplementary body portions overlying one another in face abutting relation to form the main body and with the elongate fold portions disposed laterally outwardly along opposite sides of the main body to form the cushioning edges.

* * * * *